US008162104B2

(12) United States Patent
Bastion et al.

(10) Patent No.: US 8,162,104 B2
(45) Date of Patent: Apr. 24, 2012

(54) DEVICE FOR REDUCING NOISE POLLUTION AND EQUIPMENT INCLUDING SUCH DEVICE

(75) Inventors: Bernard Bastion, Blyes (FR); Edmond Benarrous, Lentilly (FR)

(73) Assignee: AE2S, Corbas (FR)

( * ) Notice: Subject to any disclaimer, the term of this patent is extended or adjusted under 35 U.S.C. 154(b) by 178 days.

(21) Appl. No.: 12/671,578

(22) PCT Filed: Jul. 7, 2008

(86) PCT No.: PCT/FR2008/051271

§ 371 (c)(1),
(2), (4) Date: Feb. 1, 2010

(87) PCT Pub. No.: WO2009/019363

PCT Pub. Date: Feb. 12, 2009

(65) Prior Publication Data

US 2011/0226546 A1 Sep. 22, 2011

(30) Foreign Application Priority Data

Aug. 2, 2007 (FR) ..... 07 05648

(51) Int. Cl.
*E04B 1/82* (2006.01)

(52) U.S. Cl. ..... 181/284; 181/30; 52/144; 52/145

(58) Field of Classification Search ..... 181/284, 181/30; 52/144, 145
See application file for complete search history.

(56) References Cited

U.S. PATENT DOCUMENTS

| | | | | |
|---|---|---|---|---|
| 2,177,393 | A * | 10/1939 | Parkinson | 52/145 |
| 3,350,831 | A * | 11/1967 | Miller | 52/506.06 |
| 3,816,225 | A * | 6/1974 | Eckel | 428/122 |
| 5,540,027 | A * | 7/1996 | Christensen et al. | 52/459 |
| 5,907,932 | A * | 6/1999 | LeConte et al. | 52/144 |
| 6,267,347 | B1 * | 7/2001 | Ryan et al. | 248/562 |
| 7,093,814 | B2 * | 8/2006 | Meisel et al. | 248/562 |
| 7,895,803 | B2 * | 3/2011 | Downey et al. | 52/511 |
| 2002/0157329 | A1 * | 10/2002 | Berdan, II | 52/144 |
| 2006/0179762 | A1 | 8/2006 | Thome et al. | |
| 2008/0092458 | A1 * | 4/2008 | Payne | 52/144 |

FOREIGN PATENT DOCUMENTS

| | | |
|---|---|---|
| DE | 199 01 607 | 2/2000 |
| FR | 2 836 497 | 8/2003 |

OTHER PUBLICATIONS

International Search Report dated Jul. 2, 2009, from corresponding PCT application.

* cited by examiner

*Primary Examiner* — Forrest M Phillips
(74) *Attorney, Agent, or Firm* — Young & Thompson

(57) ABSTRACT

A device for reducing noise pollution includes an acoustic panel (1) and at least one member (3) for elastically holding the panel (1). This holding member (3) includes:

first and second mounting elements (8) for installing the same between a support (2) and panel (1), a spring portion (6) provided between the first and second mounting elements, a tab (7) having one end connected to the second mounting element (5) and bearing, at a distance from the end, the first mounting element (8) so that movement (D) of the acoustic panel (1) perpendicularly to the main faces (14A, 14B) thereof is permitted by an elastic deformation of the spring portion (6) in the tilting direction of the tab (7) relative to the second mounting element (5).

20 Claims, 7 Drawing Sheets

DEVICE FOR REDUCING NOISE POLLUTION AND EQUIPMENT INCLUDING SUCH DEVICE

FIELD OF THE INVENTION

The present invention relates to a device for reducing noise pollution and equipment which comprises at least one example of this device.

Noise pollution does not solely consist of unwanted noise where it is desirable to attenuate the sound volume of the noise, especially if it is not possible to eliminate the source of such noise. Noise pollution comprises anything which adversely affects the audibility of an audible message. For example, part of a sound signal emitted in a room is reflected inwards by the walls of the room where it is added to the original sound signal and degrades its intelligibility.

The user is reminded that the energy of a sound wave which strikes a wall is partly reflected by the wall, partly transmitted through the wall and partly absorbed by the wall, i.e. dissipated by friction as heat.

DESCRIPTION OF THE PRIOR ART

The use of sound attenuation barriers or screens to protect an environment against a sound source is widespread. For example, such sound attenuation bathers are found along sections of traffic lanes and around industrial plant which creates noise. Current sound attenuation barriers are generally designed mainly to reflect sound waves, although the reduction in noise annoyance on one side of a sound attenuation barrier generally results in an increase in noise annoyance on the other side where the noise source is located.

Also, the use of acoustic panels to improve the acoustic comfort of spaces with these panels covering, at least locally, the walls which delineate such spaces which can be movie theatres, bedrooms, recording studios or conference rooms, is known. The acoustic panels used generally comprise one or more thicknesses of a porous material which may, for instance, be in the form of a layer of bonded fibers in which medium and high-frequency sound waves are well attenuated by absorption. However, such panels do not make it possible to attenuate low-frequency sounds satisfactorily unless they are extremely thick, of the order of 1 m thick, a dimension which is prohibitive in many applications.

A solution which affords protection against low-frequency sound waves is proposed in document FR-2 836 497. In this solution, acoustic panels are arranged in front of a wall to which they are attached so that they are elastically supported. To achieve this, special-purpose support devices are placed between the acoustic panels and the wall. Each of them comprises an elastic member via which part of the weight of the acoustic panel is transferred into the wall. This elastic member must therefore be adequately dimensioned to be capable of supporting part of the weight of an acoustic panel. This makes it necessary to choose a highly rigid elastic member and this makes it impossible to obtain satisfactory attenuation of low-frequency sound waves.

SUMMARY OF THE INVENTION

The object of the invention is to at least improve the reduction of noise pollution, especially low-frequency noise.

According to the invention, this object is achieved thanks to a device for reducing noise pollution that comprises an acoustic panel and at least one member for elastically holding said panel, this holding member including a first and second mounting means for installing the same between a support and the acoustic panel and a spring portion provided between the first and second mounting means. The device for reducing noise pollution is characterized in that said holding member comprises a tab having one end connected to the second mounting means and bearing, at a distance from said end, the first mounting means so that a movement of the acoustic panel perpendicularly to the main faces thereof is permitted by an elastic deformation of the spring portion in the tilting direction of the tab relative to the second mounting means.

In case of horizontal vibration of the acoustic panel, the tab of the holding member or each holding member acts like a lever arm and makes the spring portion of the holding member operate in torsion around at least one axis relative to which the moment of the weight of the acoustic panel is slight or even zero. Because of this, the rigidity of the spring portion can be dimensioned taking primarily acoustic considerations into account rather than the load which the holding member is designed to bear. More precisely, this rigidity can be sufficiently low for the acoustic panel to be able to vibrate horizontally easily, especially perpendicularly to its main faces, even though it is adequately vertically supported.

In addition, the tab of the holding member increases the torque which a horizontal force acting on the panel produces on the spring portion of that holding member.

Other advantageous aspects of this device for reducing noise pollution may include the following:

- the spring portion comprises a coil spring which links the tab to the second mounting means;
- the spring comprises several non-adjacent turns;
- said tab is substantially orthogonal to one axis of the spring;
- the holding member comprises a metal wire shaped to comprise at least two portions which extend jointly, namely one portion which forms said spring and one portion which forms said tab;
- the metal wire of the holding member comprises a portion which limits said tilting of the tab in at least one direction by forming a limit stop for that tab;
- said first mounting means are provided in order to form a link which allows swiveling around a swivel axis which is substantially parallel to the acoustic panel;
- said first mounting means comprise a hook curved around said swivel axis;
- said second mounting means are provided to form a link which makes it impossible for the holding member to tilt around an axis which is parallel to said swivel axis;
- said second mounting means comprise a rigid loop which delimits a space through which an element for clamping that loop against the surface can pass.

The object of the invention is also an equipment which comprises a support characterized in that it comprises a device such as that defined above, the acoustic panel whereof is mounted on the support so that it is substantially vertical by means, in particular, of at least one example of the holding member.

Other advantageous aspects of this equipment may include the following:

- One main face of the acoustic panel faces towards a wall of the support and is separated from that wall by an air gap;
- the first mounting means are located at a lower end of said tab so that the tab is essentially longitudinally stressed by the weight of the acoustic panel;
- the spring comprises a substantially horizontal axis;
- elastic deformation allowing movement of the acoustic panel perpendicularly to its main faces takes place in the direction of rotation of the first and second ends of the spring relative to each other around an axis of that spring;

movement of the acoustic panel parallel to its main faces is allowed by elastic deformation of the spring portion in the tilting direction of the tab relative to the second mounting means.

BRIEF DESCRIPTION OF THE DRAWINGS

The invention will be made more readily understandable by the following description which is given merely by way of example and relates to the accompanying drawings in which.

DESCRIPTION OF THE PREFERRED EMBODIMENTS

Figure 1:
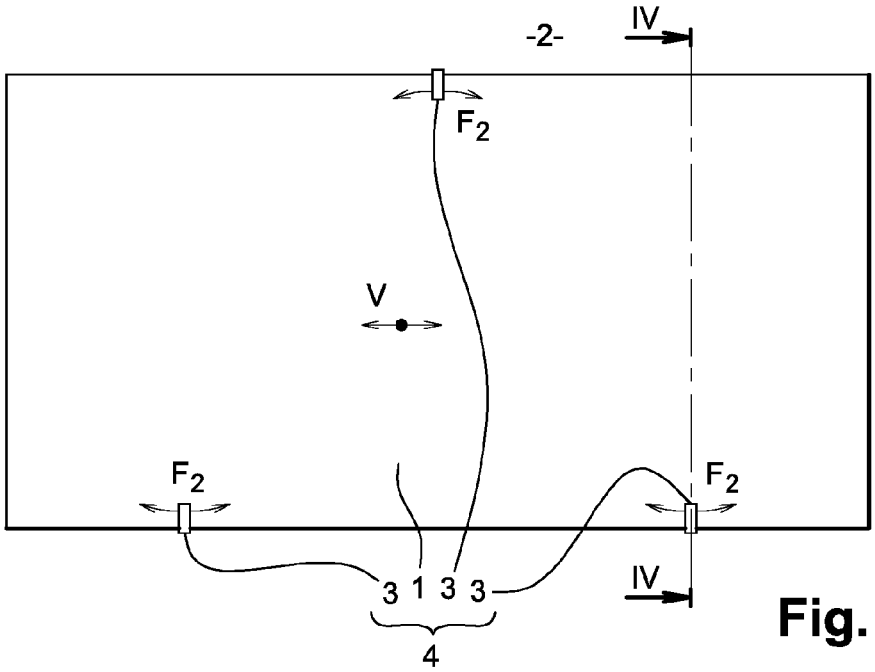
FIG. 1 is a front elevation of a first embodiment of a device according to the invention which is intended to reduce sound pollution.

FIG. 1 shows an acoustic panel 1 which is supported substantially vertically in front of a wall 2 by three identical members 3 together with which this acoustic panel 1 forms a device 4 for reducing sound pollution.

Members 3 are simple and inexpensive to manufacture. One of them is shown on its own in FIGS. 2 and 3. It is made from spring metal wire which is shaped to comprise four portions which are an extension of each other, namely one portion which forms a tab 5 for mounting member 3 on the wall 2, one portion which forms a coil spring 6, one portion which forms a suspension tab 7 and one portion which forms a hook 8 for fastening panel 1 by its edge. Spring 6 links tab 5 to one end (7A) of suspension tab 7, the other end (7B) of which has hook 8.

Figure 4:
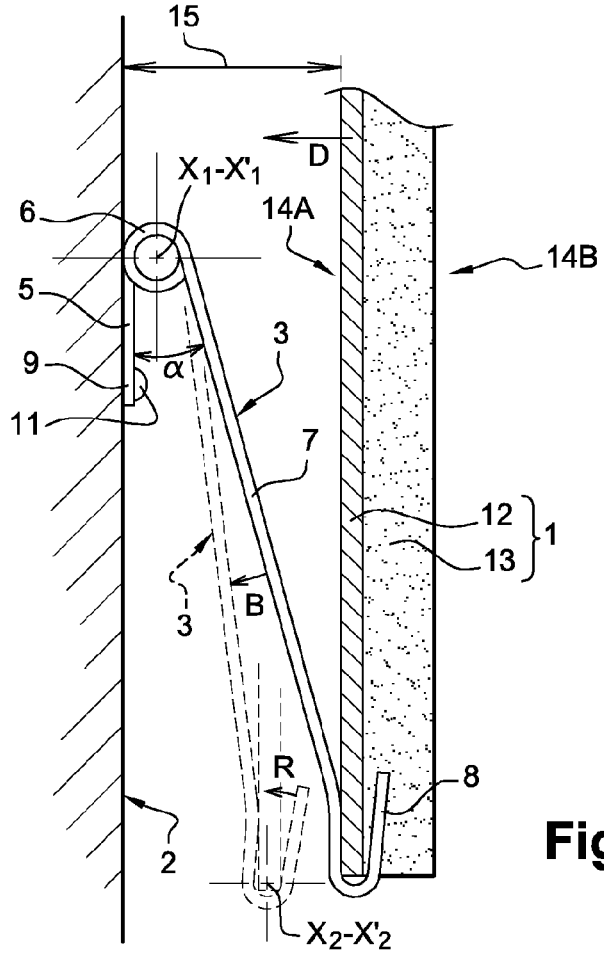
FIG. 4 is a partial cross-sectional view along line IV-IV in FIG. 1.

At a distance from spring 6, tab 5 comprises a closed loop 9 which delimits a space 10 through which the shank of a fastener such as the screw referenced 11 in FIG. 4 can pass.

Suspension tab 7 slants, i.e. it slopes relative to the vertical and horizontal. This tab 7 and hook 8 extend in a vertical plane P which is substantially perpendicular to one axis $X_1$-$X'_1$ of spring 6. Hook 8 curves around an axis $X_2$-$X'_2$ which is substantially parallel to axis $X_1$-$X'_1$.

Suspension tab 7 is angularly offset from tab 5, around an axis which is parallel to axis $X_1$-$X'_1$, by an angle which is denoted a in FIG. 4 and is less than 45°.

Figure 2:
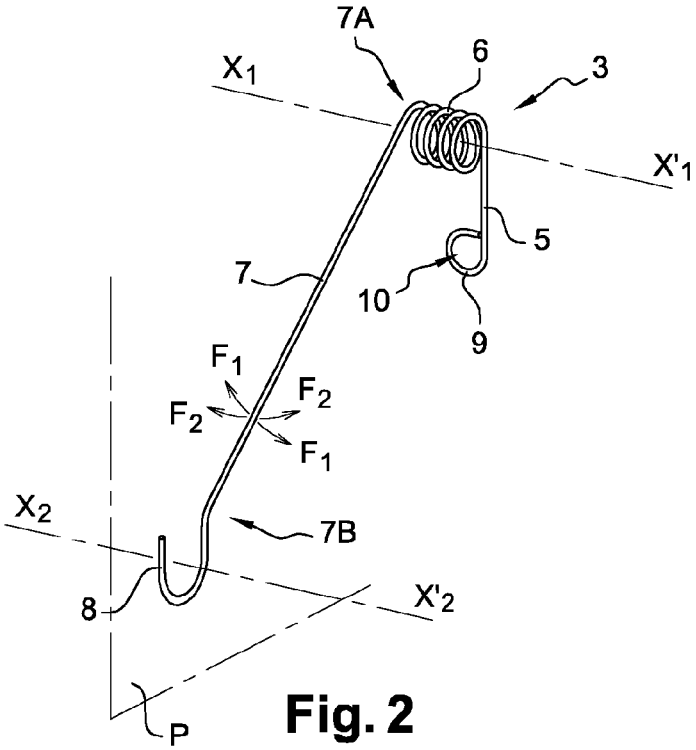
FIG. 2 is a perspective view of a holding member, three examples of which form part of the device shown in FIG. 1.
Figure 3:
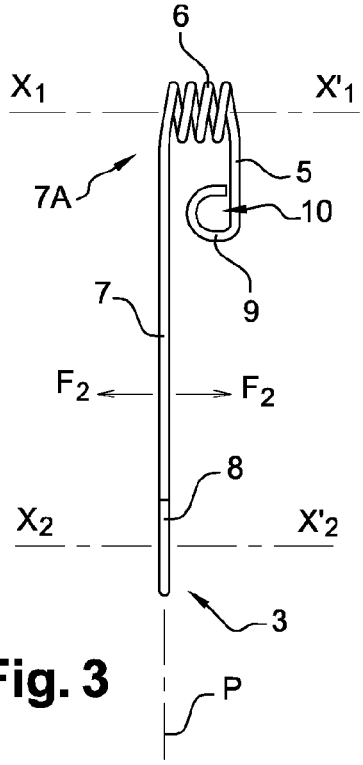
FIG. 3 is a front elevation of the holding member shown in FIG. 2.

Suspension tab 7 can be tilted relative to tab 5 in plane P downwards and upwards, i.e. in a direction in which angle $\alpha$ increases or reduces due to elastic deformation of spring 6; this is depicted by the opposite arrows $F_1$ in FIG. 2. This deformation takes place in the direction of rotation of the two opposite ends of spring 6 relative to each other, around axis $X_1$-$X'_1$.

Because the turns of the spring are not adjacent, spring 6 can also easily deform in the direction of an angular movement of its two ends relative to each other around an axis which is orthogonal to axis $X_1$-$X'_1$. This allows lateral tilting $F_2$ of suspension tab 7 away from vertical plane P in a plane which is parallel to axis $X_1$-$X'_1$, relative to tab 5.

As shown in FIG. 4, acoustic panel 1 comprises two porous, fibrous layers, namely a bonded composite fiber glass layer 12 and a layer 13 of cotton wool which covers a main face of layer 12.

The members 3 of device 4 are divided up into an upper member and two lower members, one of which can be seen in FIG. 4. Each member 3 is rigidly attached at wall 2 without any possibility of tilting by screw 11, the head of which clamps loop 9 against wall 2.

Panel 1 is supported by lower members 3, the lower edge of layer 12 rests on the hooks 8 of the members. An upper edge of this layer 12 is fastened to hook 8 of upper member 3 which turns back on itself for this purpose relative to lower members 3. The axes $X_1$-$X'_1$ of springs 6 are substantially horizontal and parallel to panel 1 and wall 2. The same applies to axes $X_2$-$X'_2$. The rear main face 14A of panel 1 faces wall 2, from which it is separated by an air gap 15.

The above description shows that device 4 can be installed easily and quickly.

Because of the significant slope of tabs 7 of lower members 3 which means that their hooks 8 are lower than their springs 6, the moment of the weight of panel 1 with respect to the axes $X_1$-$X'_1$ of the springs 6 is low. The weight of panel 1 is therefore only a minor consideration when dimensioning springs 6 and the springs can therefore not be very stiff in order to facilitate horizontal vibration of panel 1.

Panel 1 can vibrate perpendicularly to its main faces 14A and 14B, as shown in FIG. 4 where arrow D denotes movement of panel 1 towards wall 2. Such movement D is accompanied by tilting B of each tab 7 towards wall 2 around axis $X_1$-$X'_1$ and swiveling R of panel 1 relative to each tab 7 in each hook 8 around each axis $X_2$-$X'_2$. When it vibrates perpendicularly to its main faces 14A and 14B, panel 1 also moves in a direction opposite to that shown by arrow D, during such movement device 4 behaves in the same way as described above, but in the opposite direction.

Panel 1 can also vibrate parallel to its main faces 14A and 14B in the direction shown by the double-headed arrow V in FIG. 1 thanks to the ability of tabs 7 to tilt laterally.

Figure 5:
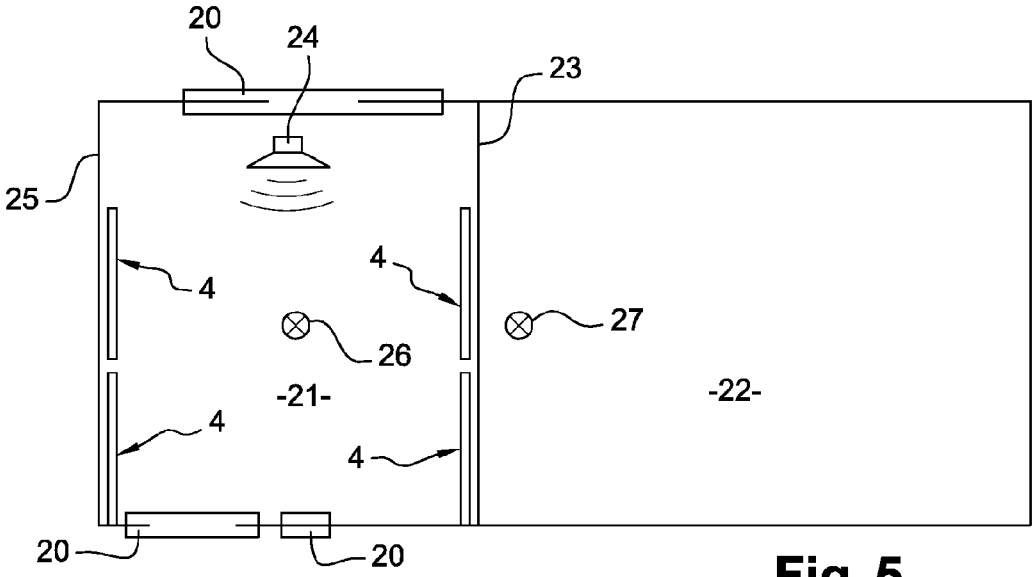
FIG. 5 is a schematic showing rooms for conducting experiments on the device shown in FIGS. 1 and 4.

Tests were conducted in rooms as shown in FIG. 5 where every reference 20 denotes a door jamb or window frame. These rooms comprise two adjacent rooms 21 and 22 which are separated from each other by a common partition 23. A sound source 24 is placed in room 21, one partition 25 of which is fitted with a first pair of devices 4. Partition 23 is fitted with a second pair of devices 4 placed in room 21 and facing the first pair of devices 4. Panels 1 of devices 4 in room 21 together cover an area of approximately 2.25 $m^2$, i.e. 19% of the total surface area of the surfaces which delimit the internal volume of room 21.

Measurements were performed simultaneously in room 21 and room 22 using a microphone 26 located between the two pairs of devices 4 and a microphone 27 located in room 22 close to partition 23. Identical measurements for the same sound produced by sound source 24 were performed without devices 4 in room 21 as well as when each of these devices 4 was replaced by panel 1 fixed by spacers in the form of foam blocks.

The results of the tests conducted under the conditions described below are summarized in the following table:

| | Noise level (dB) | | Reverberation time (s) | Clearness index (%) |
|---|---|---|---|---|
| | In room 22 | In room 21 | (In room 21) | (In room 21) |
| No device 4, no panel 1 | 60.6 | 94.6 | 0.445 | 81.1 |
| With four devices 4 in configuration shown in FIG. 5 | 57.7 | 91 | 0.180 | 98.6 |
| With four panels 1 fixed by foam blocks instead of four devices 4 | 59.4 | 91.7 | 0.200 | 97.8 |

The above table shows that devices 4 reduce the sound volume both in room 21 and room 22. The noise reduction in rooms 21 and 22 is due to a large part of the energy of the sound waves being effectively absorbed by devices 4. It was established that this absorption occurs in low, medium and high frequencies as illustrated by comparing the curves in FIG. 5A and comparing the curves in FIG. 5B.

Figure 5A:
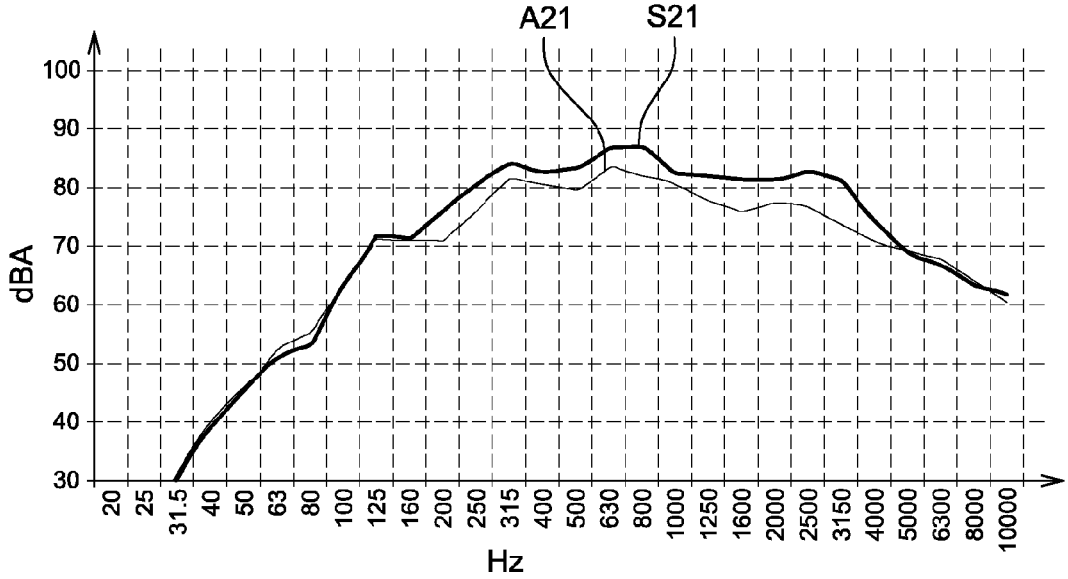
FIG. 5A is a graphical representation of the sound level measured in room 21 in FIG. 5 as a function of frequency when room 21 is fitted with four examples of the device shown in FIGS. 1 and 4, i.e. in the configuration shown in FIG. 5 (curve A21) and when these four examples are not fitted (curve S21)
Figure 5B:
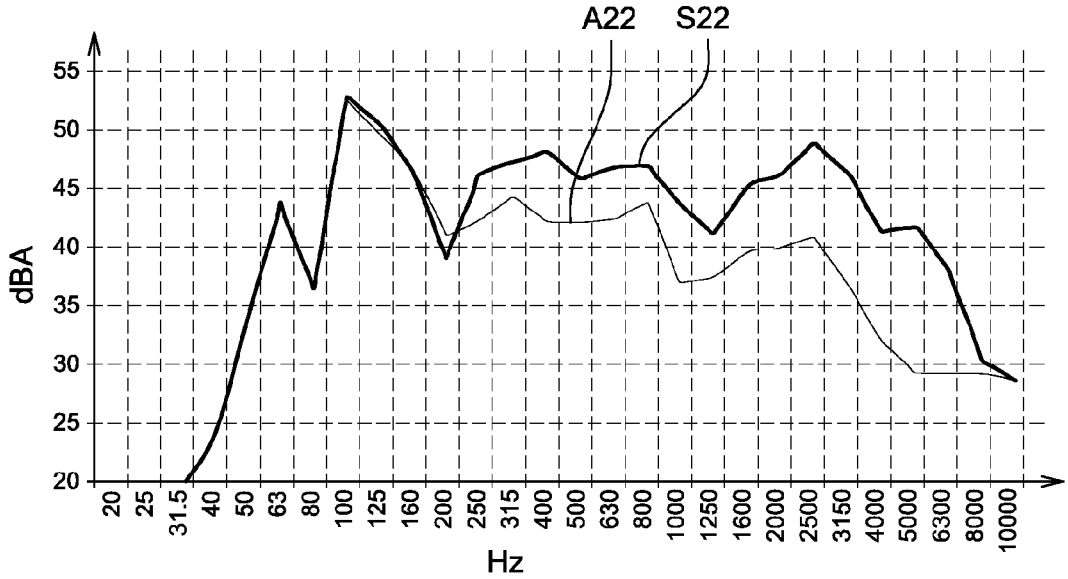
FIG. 5B is a graphical representation of the sound level measured in room 22 in FIG. 5 as a function of frequency when room 21 is fitted with four examples of the device shown in FIGS. 1 and 4, i.e. in the configuration shown in FIG. 5 (curve A22) and when these four examples are not fitted (curve S22)

In FIG. 5A, curve A21 was plotted based on sound level measurements in room 21 fitted with four devices 4 arranged in the configuration in FIG. 5, whereas curve S21 was plotted based on sound level measurements in the same room 21 without devices 4 or any other acoustic panel. In FIG. 5B, curve A22 was plotted based on sound level measurements in room 22 with four devices 4 fitted in room 21 arranged in the configuration in FIG. 5, whereas curve S22 was plotted based on sound level measurements in the same room 22 without devices 4 or any other acoustic panel in room 21. Obviously, the sound source 24 was producing the same sound when the measurements used to plot curves A21 and A22 were performed simultaneously and when the measurements used to plot curves S21 and S22 were performed simultaneously.

In addition, comparing the reverberation times obtained in the various configurations tested and comparing the clearness indexes obtained in the same configurations shows that the presence of devices 4 is also accompanied by undeniable gains in terms of perceived acoustics.

Besides this, the standing-wave ratio in room 21 was reduced when devices 4 were present; this results in increased homogeneity of the acoustic field; this homogeneity is important, in particular, when listening to music.

It should be noted that the performance stated above was obtained when room 21 was only partially fitted with devices 4. Even better performance can therefore be expected when a greater number of devices 4 is installed in room 21, especially in front of partition 23.

Figure 6:
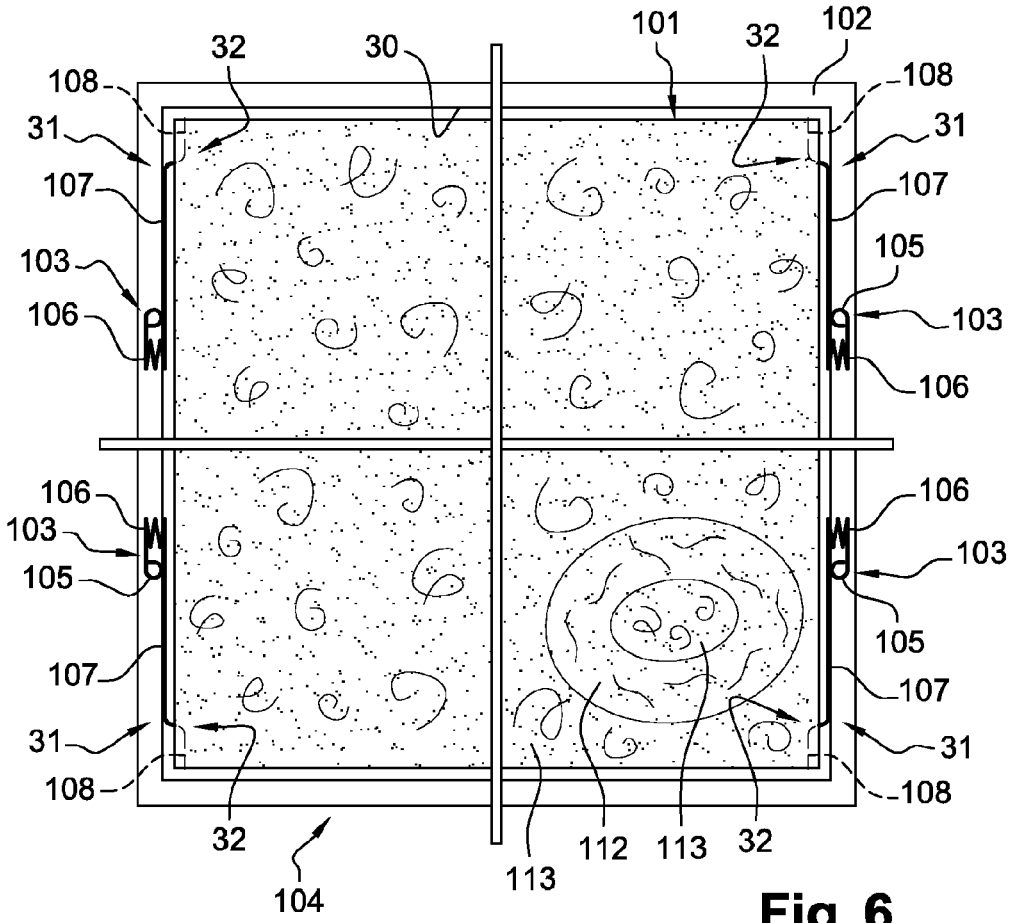
FIG. 6 is a front elevation of a device for reducing noise pollution in accordance with a second embodiment of the invention.

FIG. 6 shows another device 104 for reducing noise pollution. In the following text, only those features which distinguish it from device 4 are described. In addition, the reference used below to denote part of device 104 which is similar or equivalent to a referenced part of device 4 is obtained by adding 100 to the reference used to denote that part of device 4.

Acoustic panel 101 is a sandwich panel comprising two layers 113 which can be made of cotton wool or another material and between which there is a composite fiber glass layer 112. This panel 101 is mounted using two pairs of members 103 in an opening 30 delimited by a frame shaped support 102. Frame 102 comprises two uprights, each of which bears a pair of members 103 arranged along the lateral edge of panel 101.

Tab 107 of each member 103 comprises a pair of reverse bends 31 and 32 which inwardly displace a hook 108 relative to spring 106 which is part of the same member 103 as hook 108. In this respect, it should be noted that the two members 103 on the same side of panel 101 differ from each other in that bends 31 and 32 of one member are reversed compared with bends 31 and 32 of the other member.

Figure 7:
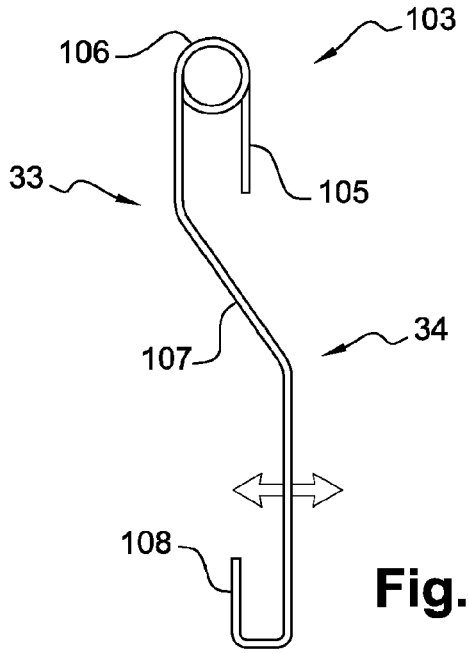
FIG. 7 is a side view of a holding member, four examples of which form part of the device shown in FIG. 6.

Thus, as shown in FIG. 7, tabs 105 and 107 of a single member 103 are not angularly offset relative to each other. Each tab 107 comprises another pair of reverse bends 33 and 34 which are curved in the plane of FIG. 7 and by means of which hook 108 of one member 103 is an extension of tab 105 of that member 103.

Figure 8:
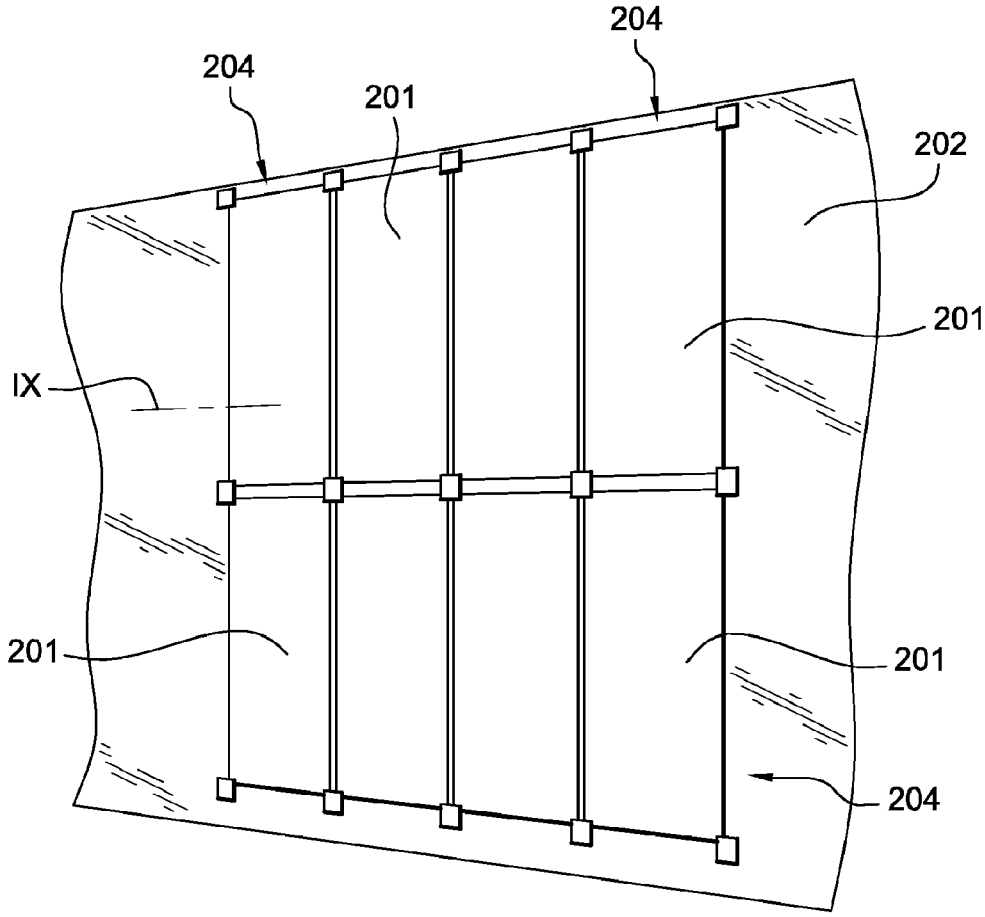
FIG. 8 is a perspective view of part of a room, one wall of which is fitted with two horizontal adjacent rows of several devices for reducing noise pollution in accordance with a third embodiment of the invention.

FIG. 8 shows a room in which several horizontal abutting rows of devices 204 for reducing noise pollution are installed. These devices 204 are supported by a wall 202 of the room. These devices are similar to each other and in accordance with a third embodiment of the invention. In the following text, only those features which distinguish them from device 4 are described. In addition, the reference used below to denote part of device 204 which is similar or equivalent to a referenced part of device 4 is obtained by adding 200 to the reference used to denote that part of device 4.

Figure 9:
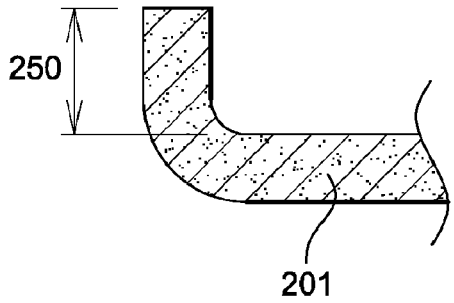
FIG. 9 is a cross-section through plane IX in FIG. 8 and shows an edge of a panel which constitutes one of the devices for reducing noise pollution shown in FIG. 8.

As shown in FIG. 9, panel 201 of device 204 is a part all in one block which is compression molded and made of a substantially homogeneous fiber agglomerate such as glass fibers bonded by a polymer bonding agent. Over the entire length of its periphery, panel 201 has a brim 250 which makes it rigid and is rearwardly directed.

Figure 10:
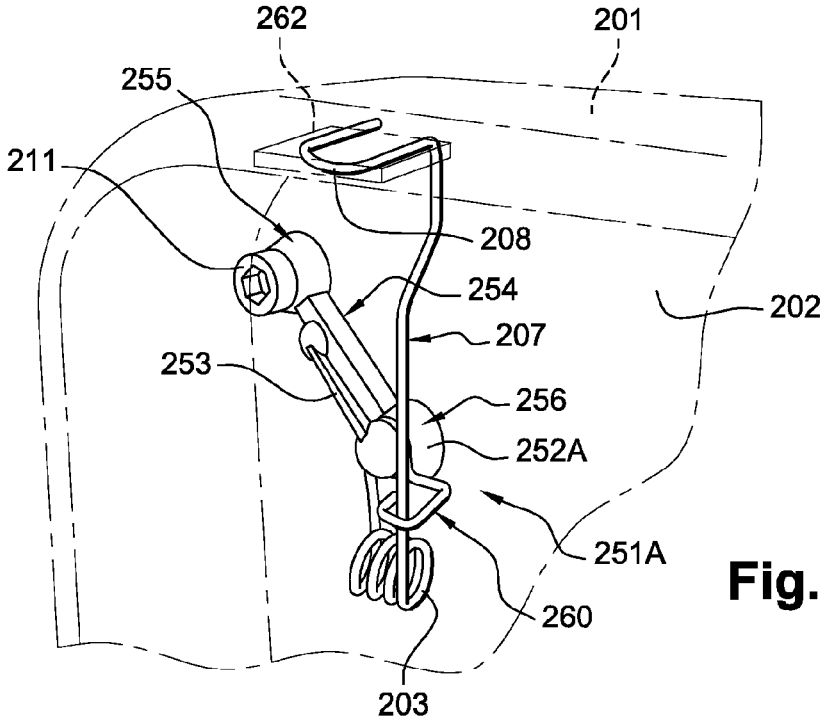
FIG. 10 is a perspective view of a mounting system which constitutes one of the devices for reducing sound pollution shown in FIG. 8.
Figure 12:
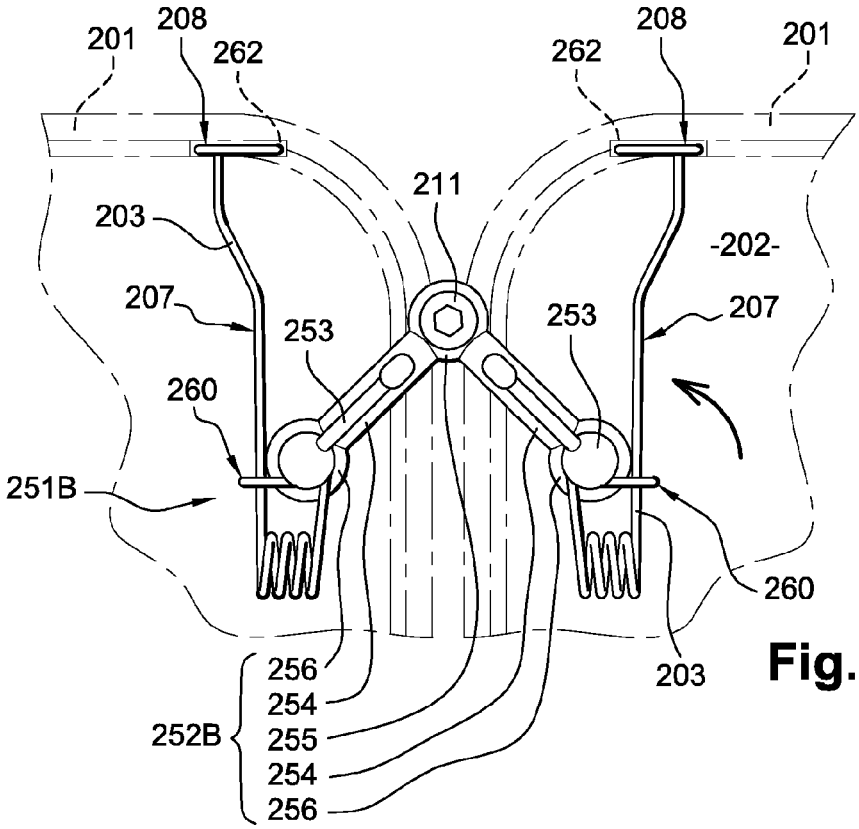
FIG. 12 is a front elevation of a mounting system which constitutes two adjacent devices for reducing sound pollution shown in FIG. 8.

Each panel 201 is mounted on the wall 202 by means of four mounting systems which are located at each of its corners. Thus, as shown in FIGS. 10 and 12, each of these mounting systems 251A and 251B comprises a metal base 252A or 252B which is fixed to wall 202 by screw 211, as well as at least one holding member 203 locked on this base by locking key 253. There are two types of metal bases for mounting systems 251A or 251B. A base of one of these two types is referred to as 252A in FIG. 10. A base of the other type is referred to as 252B in FIG. 12.

As can be seen in FIG. 10, each base 252A comprises a single arm 254 which rigidly links a retaining ring 255 to a mounting portion 256 of a member 203. Ring 255 is provided to fix base 252A by clamping it against wall 202 by means of screw 211, the shank of which passes through this ring. Portion 256 has a bulging shape and comprises means of locking by means of which key 253 provided with additional means can be locked in a position in which member 203 is secured. These locking means which are known in themselves are hidden by key 253 in FIG. 10. They can be a helical groove for example.

Figure 11:
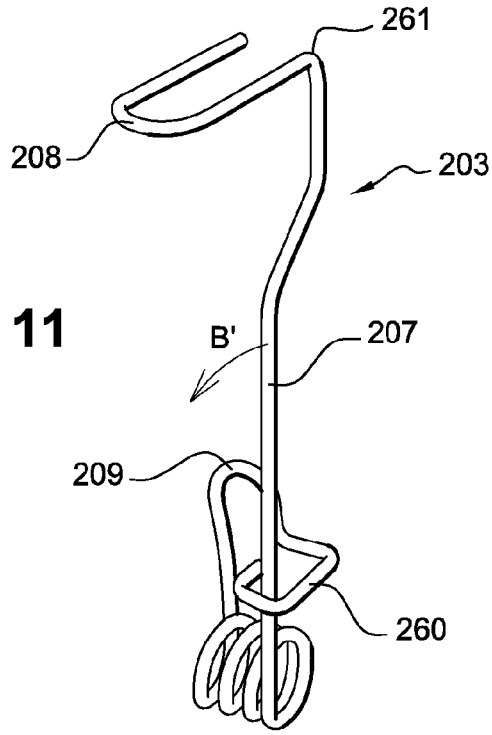
FIG. 11 is a perspective view of a holding member which constitutes part of the mounting system shown in FIG. 10.

Member 203 is shown on its own in FIG. 11. Portion 209 thereof is a laterally open ring which extends only over half a turn. It extends as security loop 260 which surrounds tab 207 so as to limit its angular deflection, thereby forming a limit stop for this tab 207. In particular, loop 260 prevents tab 207 from being tilted too far forward, i.e. in the direction of arrow B' which might result in damage to member 203, for instance if an excessively high tensile force was exerted on panel 201 because of a clumsy movement or a person or a moving object accidentally catching on the panel.

A bend 261 which is substantially at right angles links tab 207 to hook 208, thanks to which this hook 208 is tilted a quarter turn relative to tab 207 so that it protrudes forwardly and, because of this, can be inserted in a retention clip 262 which is rigidly associated with rim 250 of panel 201. Every panel 201 has four clips 262 into which four hooks 208 are inserted at the time the panel is mounted so that the panel is subsequently secured thereto.

Every base 252A is part of one of several mounting systems 251A which are located at the left and right ends of rows of panels 201. Every mounting system 251B is located in a gap which separates two consecutive panels 201.

FIG. 12 shows such a mounting system 251B which contributes to supporting two consecutive adjacent panels 201 in a single horizontal row of panels 201. To achieve this, its base 252B bears two members 203, each of which partly supports one of these two panels 201. This base 252B comprises two mounting portions 256 and two arms 254, each of which links a single ring 255 to one of these two portions 256. In each mounting portion 256, half loop 209 of one of the two members 203 is rigidly fixed by key 253.

Figure 13:
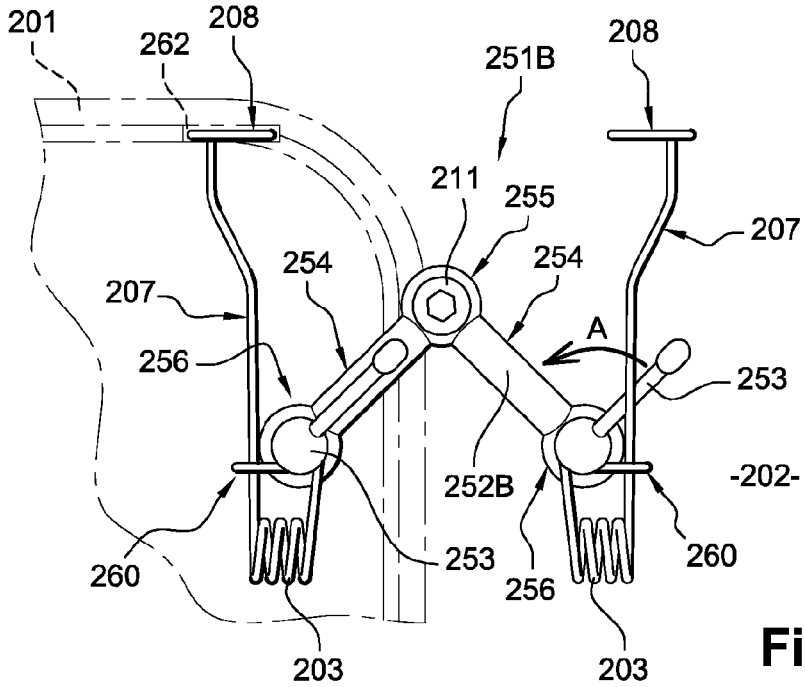
FIG. 13 is a view similar to that in FIG. 12 and shows the same mounting system as that in FIG. 12 and illustrates one step during its installation.

A simple easy-to-perform action is enough to lock key 253 in the position in which member 203 is secured once the tip of this key has been inserted in mounting portion 256. This action involves pivoting key 253 a quarter of a turn, as indicated by arrow A in FIG. 13.

Although they are advantageous in terms of ease of assembly, keys 253 can be replaced by traditional screws, subject to portions 256 being adapted accordingly.

The invention is not confined to the embodiments described above. In particular, the number of members 3 or 103 in a device 4 or 104 may differ from those stated above.

Also, tab 5 or 105 of a member 3 or 103 can be fixed to acoustic panel 1 or 101, in which case hook 8 or 108 of that member is fastened to a pin fixed to support 2 or 102.

In addition, tab 7 or 107 can form the spring portion of member 3 or 103 or, at least, be part of it and be capable of being elastically bent.

Equally, members 3 need not be made of metal wire. For example, they can be made of an injection-molded polymer, in which case they can be integral with part of the acoustic panel.

In addition, acoustic panel 1 or 101 may only comprise a single layer 12 or 13 or 112 or 113. It may also comprise more than three layers.

The invention claimed is:

1. A device for reducing noise pollution, comprising an acoustic panel and at least one member for elastically holding this panel, the at least one holding member comprising first and second mounting means for installing the same between a support and the acoustic panel and a spring portion provided between the first and second mounting means, characterized in that said holding member comprises a tab having one end connected to the second mounting means and bearing, at a distance from said end, the first mounting means so that a movement of the acoustic panel perpendicularly to the main faces thereof is primarily permitted by an elastic deformation of the spring portion in the tilting direction of tab relative to the second mounting means, the tilting direction being perpendicular to the support.

2. Device as claimed in claim 1, characterized in that the spring portion comprises a coil spring which links tab to second mounting means.

3. Device as claimed in claim 2, characterized in that spring comprises several non-adjacent turns.

4. Device as claimed in claim 2, characterized in that said tab is substantially orthogonal to an axis of spring.

5. Device as claimed in claim 2, characterized in that said holding member comprises a metal wire shaped to comprise at least two portions which extend jointly, namely one portion which forms said spring and one portion which forms said tab.

6. Device as claimed in claim 5, characterized in that the metal wire of holding member comprises a portion which limits said tilting of tab in at least one direction by forming a limit stop for that tab.

7. Device as claimed in claim 1, characterized in that said first mounting means are provided to form a link which allows swiveling around a swivel axis which is substantially parallel to acoustic panel.

8. Device as claimed in claim 7, characterized in that said first mounting means comprise a hook curved around said swivel axis.

9. Device as claimed in claim 7, characterized in that said second mounting means are provided to form a link which makes it impossible for the holding member to tilt around an axis which is parallel to said swivel axis.

10. Device as claimed in claim 9, characterized in that said second mounting means comprise a rigid loop which delimits a space through which an element for clamping that loop against a surface can pass.

11. Equipment comprising a support characterized in that it comprises a device which is in accordance with claim 1 and the acoustic panel whereof is mounted on support so that it is substantially vertical by means, in particular, of at least one example of holding member.

12. Equipment as claimed in claim 11, characterized in that main face of acoustic panel faces towards wall of the support and is separated from this wall by an air gap.

13. Equipment as claimed in claim 11, characterized in that said first mounting means are located at a lower end of said tab so that this tab is essentially longitudinally stressed by the weight of acoustic panel.

14. Equipment as claimed in claim 11, wherein the spring portion comprises a coil spring which links tab to second mounting means said spring comprising an axis which is substantially horizontal.

15. Equipment as claimed in claim 14, characterized in that said elastic deformation allowing movement of acoustic panel perpendicularly to its main faces takes place in the direction of rotation of the first and second ends of spring relative to each other around axis of that spring.

16. Equipment as claimed in claim 11, characterized in that movement of acoustic panel parallel to its main faces is allowed by elastic deformation of spring portion in the tilting direction of tab relative to second mounting means.

17. A device for reducing noise pollution, comprising:

an acoustic panel with front and back surfaces, and a perimeter edge extending between the front and back surfaces; and a spring metal writhe e member consisting essentially of i) a mounting tab for mounting the member to a wall, ii) a hook engaged in the perimeter edge of the acoustic panel, the member, when mounted to the wall, elastically holding the panel substantially vertical in front of the wall, iii) a coil spring located adjacent the tab and, with the member mounted to the wall, bearing against the wall, and iv) a suspension tab extending from the coil spring to the hook, the suspension tab sloping i) downward from the coil spring and outward from the wall towards ii) the hook and a bottom part of the perimeter edge of the acoustic panel, wherein the panel vibrates perpendicularly with respect to the wall due to elastic deformation of the coil spring.

18. The device of claim 17, wherein, the mounting tab comprises a closed loop delimiting a space for accepting a shank of a fastener, the coil spring comprises plural non-adjacent turns, and the suspension tab is substantially orthogonal to an axis of the spring.

19. A wall system for reducing noise pollution, comprising:

an acoustic panel with front and back surfaces, and a perimeter edge extending between the front and back surfaces; and plural spring metal wire members, each member comprising i) a mounting tab mounting the member to a wall, ii) a hook engaged in the perimeter edge of the acoustic panel, the member elastically holding the panel substantially vertical in front of the wall, iii) a coil spring located adjacent the tab and bearing against the wall, and iv) a suspension tab extending from the coil spring to the hook, the suspension tab sloping i) away from the coil spring and outward from the wall towards ii) the hook and the perimeter edge of the acoustic panel, wherein the panel vibrates perpendicularly with respect to the wall due to elastic deformation of the coil spring of each member.

20. The device of claim 19, wherein, the mounting tab comprises a closed loop delimiting a space for accepting a shank of a fastener, the coil spring comprises plural non-adjacent turns, and the suspension tab is substantially orthogonal to an axis of the spring.

* * * * *